United States Patent [19]

Nowacki et al.

[11] 4,237,777

[45] Dec. 9, 1980

[54] METHOD AND APPARATUS FOR ERECTING AND FORMING DOUBLE WALL CONTAINERS

[75] Inventors: Ulrich G. Nowacki, Leisure City; Edwin C. Weibrecht, Pompano Beach, both of Fla.

[73] Assignee: International Paper Company, New York, N.Y.

[21] Appl. No.: 936,837

[22] Filed: Aug. 25, 1978

[51] Int. Cl.[3] ..... B31B 1/06

[52] U.S. Cl. ..... 493/100; 493/113

[58] Field of Search ..... 93/36.01, 35 R, 43, 93/49 M, 36.6, 47, 39, 53 SD; 53/175

[56] References Cited

U.S. PATENT DOCUMENTS

| | | | |
|---|---|---|---|
| 2,216,586 | 10/1940 | Burton | 93/36.01 |
| 2,837,014 | 6/1958 | Burke | 93/36.01 |
| 3,145,464 | 8/1964 | Green | 93/36.01 X |
| 3,369,339 | 2/1968 | Speiser | 93/36.01 X |
| 3,590,700 | 7/1971 | Paxton | 93/39 X |
| 3,690,224 | 9/1972 | Derderian et al. | 93/36.01 |
| 3,779,140 | 12/1973 | Yamamura | 93/36.01 |
| 3,821,874 | 7/1974 | Jones | 93/36.01 X |
| 3,935,798 | 2/1976 | Paxton | 93/36.01 X |
| 4,052,931 | 10/1977 | Morse et al. | 93/36.01 |
| 4,160,406 | 7/1979 | Nowacki | 93/49 M X |

FOREIGN PATENT DOCUMENTS

| | | | |
|---|---|---|---|
| 584488 | 9/1933 | Fed. Rep. of Germany | 93/36.01 |

*Primary Examiner*—William R. Briggs

*Attorney, Agent, or Firm*—Donald E. Degling

[57] ABSTRACT

An apparatus and process for the production of double wall containers is disclosed. The apparatus comprises a single wall container feeding station, a container blank feeding station and an erecting and telescoping station. In accordance with the disclosed process, flat carton blanks are fed in timed sequence from a blank feeding station into an erecting station where the blank is erected. Previously formed single wall containers are aligned in a feeding station with the erected blank and then telescoped into the erected blank with the aid of a plurality of oscillating guide arms disposed between the single wall container and the erected blank. Thereafter, the completed double wall container is ejected from the erecting and telescoping station.

3 Claims, 8 Drawing Figures

FIG.4
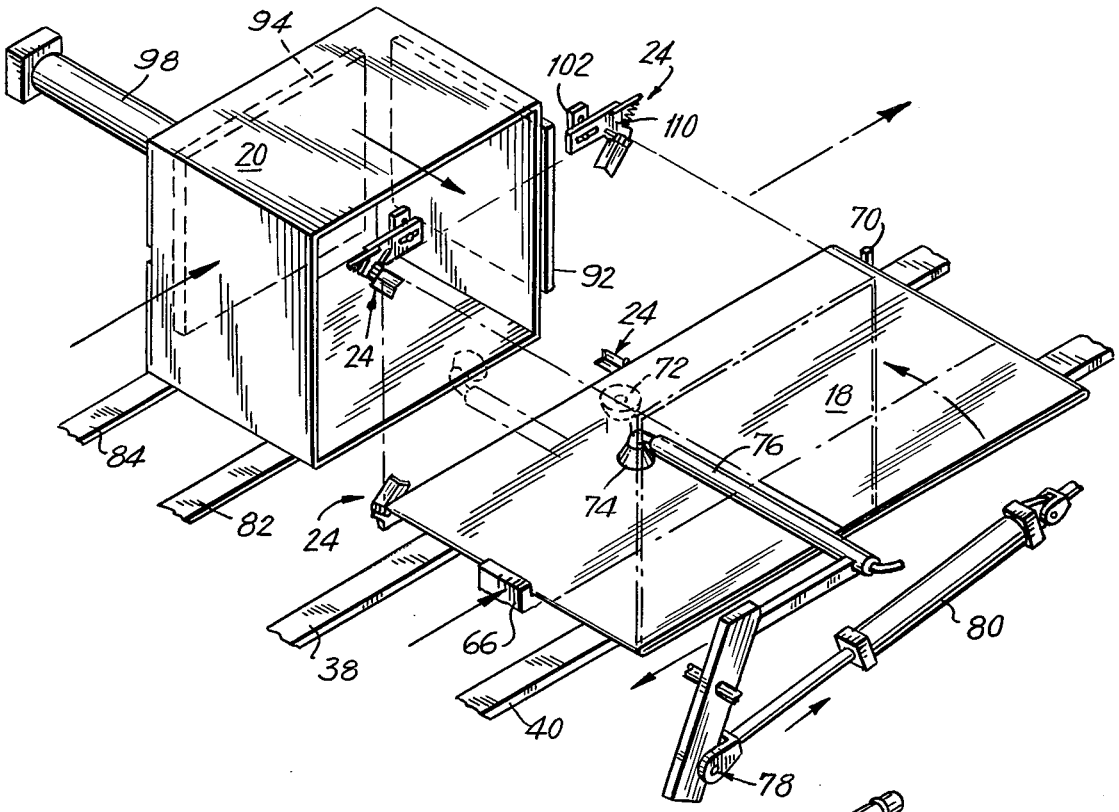
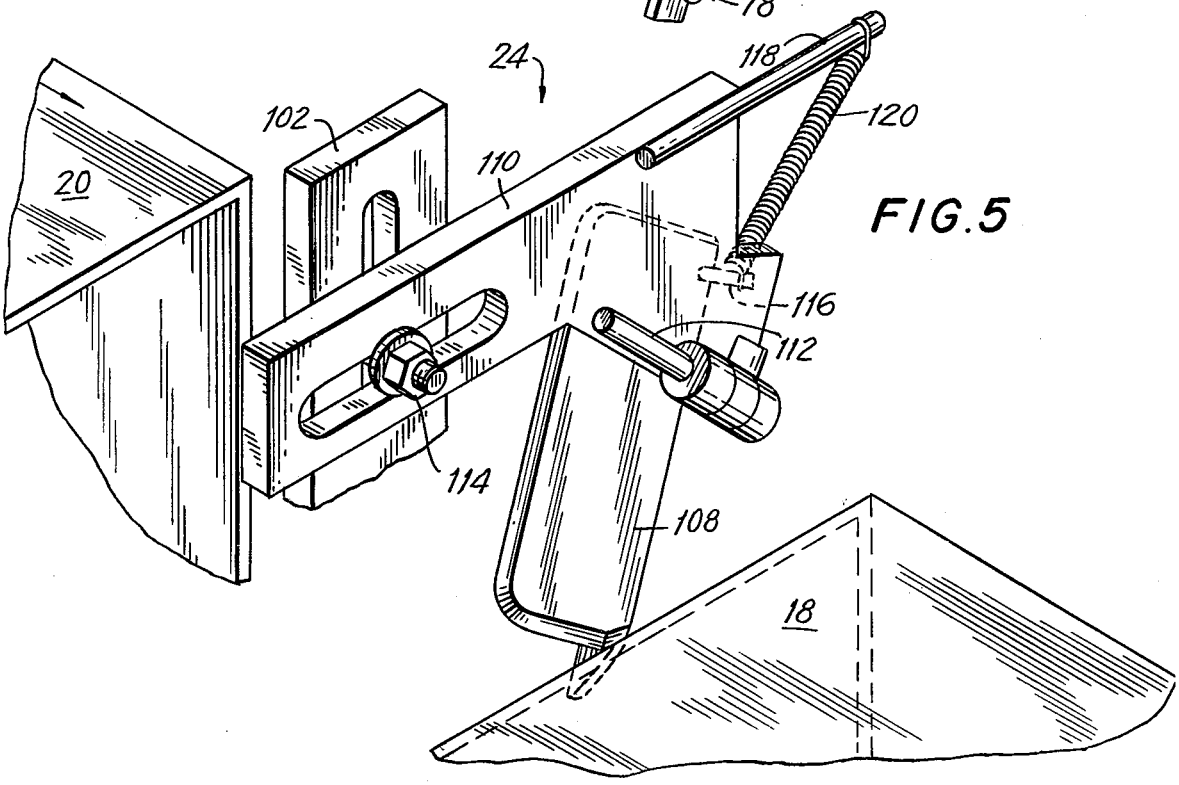
FIG.5

METHOD AND APPARATUS FOR ERECTING AND FORMING DOUBLE WALL CONTAINERS

BACKGROUND OF THE INVENTION

1. Field of the Invention

The present invention relates to container fabrication equipment and more particularly to a method and apparatus for erecting paperboard cartons from flat blanks therefor and stuffing or telescoping a first carton within a second carton to form a double wall container.

2. Prior Art

Paperboard cartons are commonly used by manufacturers to ship manufactured goods such as food products, machine parts and the like to distributors, retail outlets or ultimate consumers. Such paperboard cartons are frequently manufactured in the form of carton blanks which, for convenience, may be shipped flat to the product manufacturer. A common form of carton comprises a single blank having four side panels joined together opposite side edges of the panels and having four top panels and four bottom panels joined to respective opposite edges of the side panels. While such blanks may be erected and sealed manually by forming a blank into a rectangular tube, folding in the bottom end panels, applying adhesive and finally folding and sealing the lateral bottom panels, it is economically desirable to perform some or all of these operations automatically in a sealing machine or in an erecting and sealing machine. An erecting and sealing machine designed to erect and seal a carton of the type referred to is disclosed in application Ser. No. 917,483 filed June 21, 1978 and assigned to the assignee of the present invention.

In certain circumstances, it may be desirable to use a double wall container so as to provide greater protection to the products packed within the container. Such protection may take the form of increased crushing resistance whereby a greater number of containers may be stacked vertically. It is convenient to form the double wall container by using a second blank having dimensions slightly larger or smaller than the first blank whereby the erected blanks may be telescoped together to form the double walled container. As with the erecting and sealing machine disclosed in application Ser. No. 917,483, the second blank may be erected manually and placed inside, or outside the carton formed from the first blank but it is preferable to perform the necessary steps automatically in an erecting and stuffing machine.

BRIEF SUMMARY OF THE INVENTION

The present invention relates to a compact high speed carton erecting and stuffing or telescoping machine and method employing a dual feeding system whereby erected and sealed single wall containers are fed from a first feed station while flat blanks are fed from a second feeding station into an erecting station. Upon erection of the flat blank in the erecting station, the erected blank is aligned with the single wall container; telescoped therewith to form a double wall container; and then ejected from the machine. Erected and sealed single wall containers are preferably delivered to the first feed station from an erecting and sealing machine of the type disclosed in pending application Ser. No. 917,483.

The flat blanks delivered from the second feeding station are first positioned by stop means and then erected to a squared position. Alignment between the single wall container and the erected blank is effected by a plurality of spring biased oscillating guide arms arranged to register with the inner surface of the corners of the erected blank and the outer surface of the corners of the single wall container. The single wall container is then telescoped into the erected blank by a transversely reciprocable ram means until the oscillating guide arms are released from engagement with the single wall container and, as a result of the spring bias, clear the edges of the erected blank. The telescoped blank and container, now comprising a double wall container, is then ejected from the machine.

In its preferred form, the double wall container comprises a single wall container having sealed bottom panels and no top panels telescoped with an erected blank having no bottom panels and unfolded and unsealed top panels.

The erecting and stuffing machine according to the present invention is adjustable to accommodate a range of carton sizes having various lengths, widths and depths. The machine is operable at a range of speeds up to a maximum of about 30 cartons per minute.

DESCRIPTION OF THE DRAWINGS

FIG. 4 is a fragmentary perspective view of the principal functional portions of the machine showing a container in the container feeding station and an unerected blank positioned in the erecting and telescoping station;

FIG. 5 is a fragmentary perspective view of one of the spring biased oscillating guide arms in its disengaged position;

DESCRIPTION OF THE PREFERRED EMBODIMENT

Figure 1:
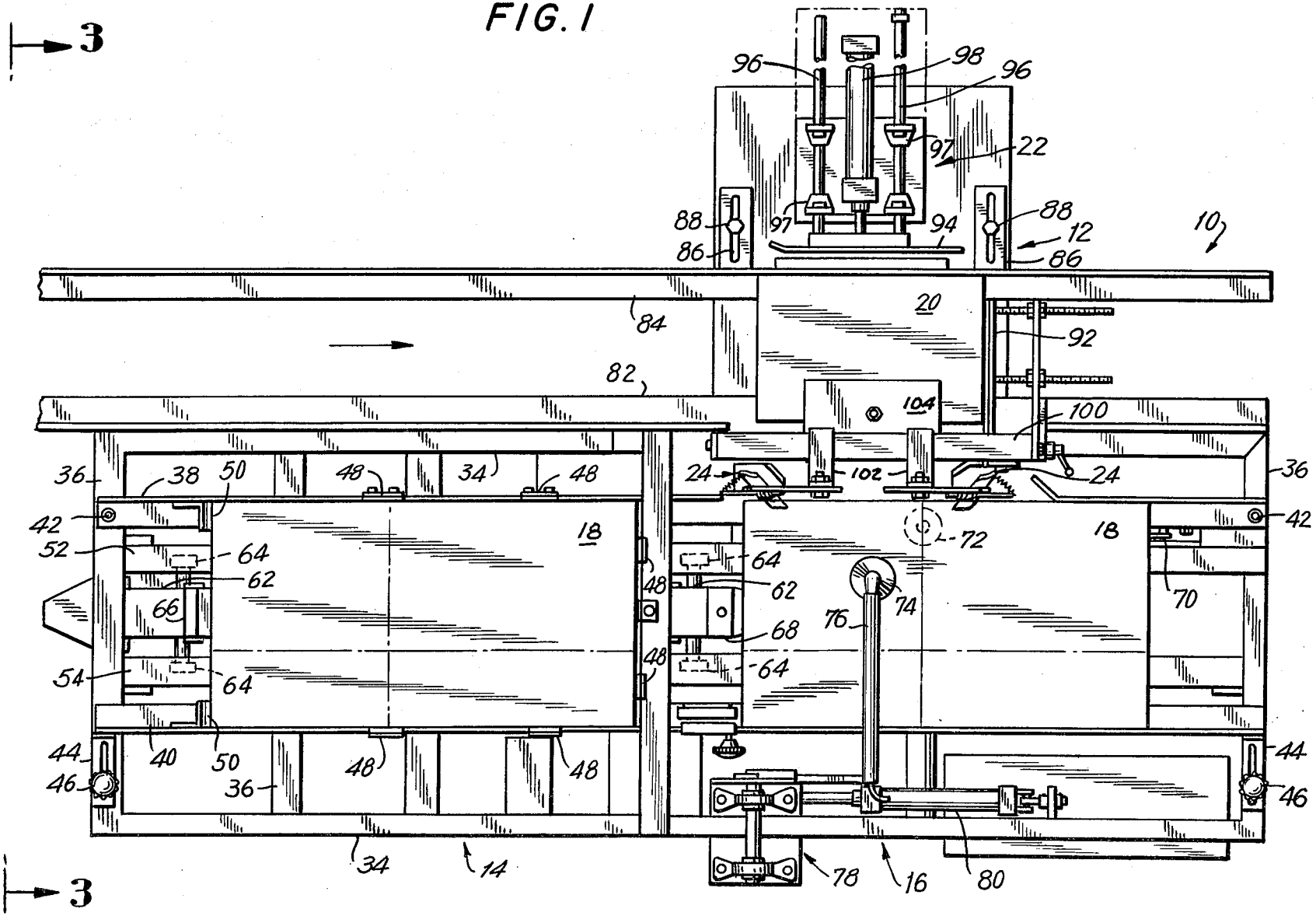
FIG. 1 is a top plan view of the erecting and stuffing machine according to the present invention wherein the container feeding station is at the top right; the blank feeding station is at the lower left and the erecting and telescoping station is at the lower right.
Figure 2:
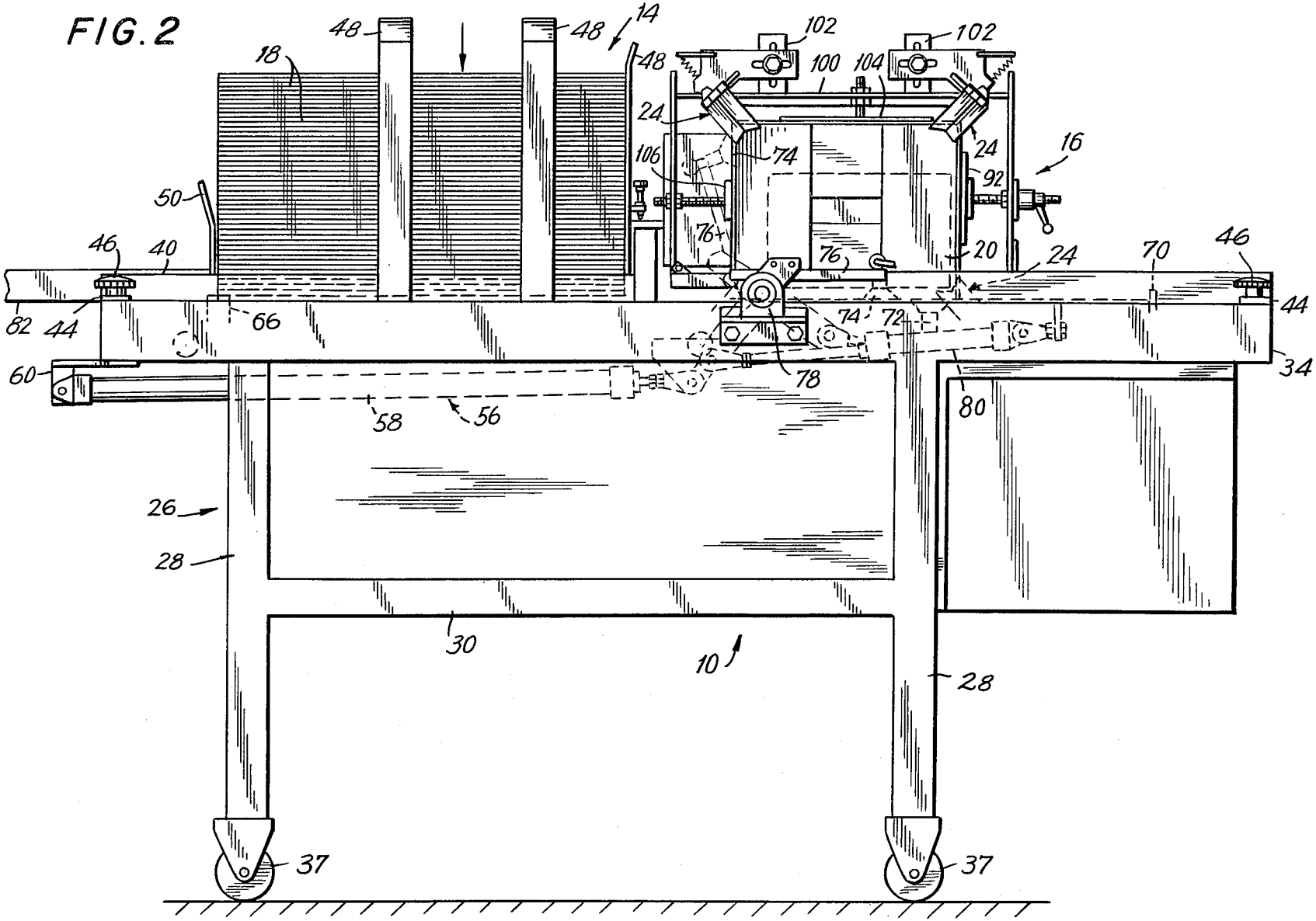
FIG. 2 is a front elevational view of the erecting and stuffing machine shown in FIG. 1.
Figure 3:
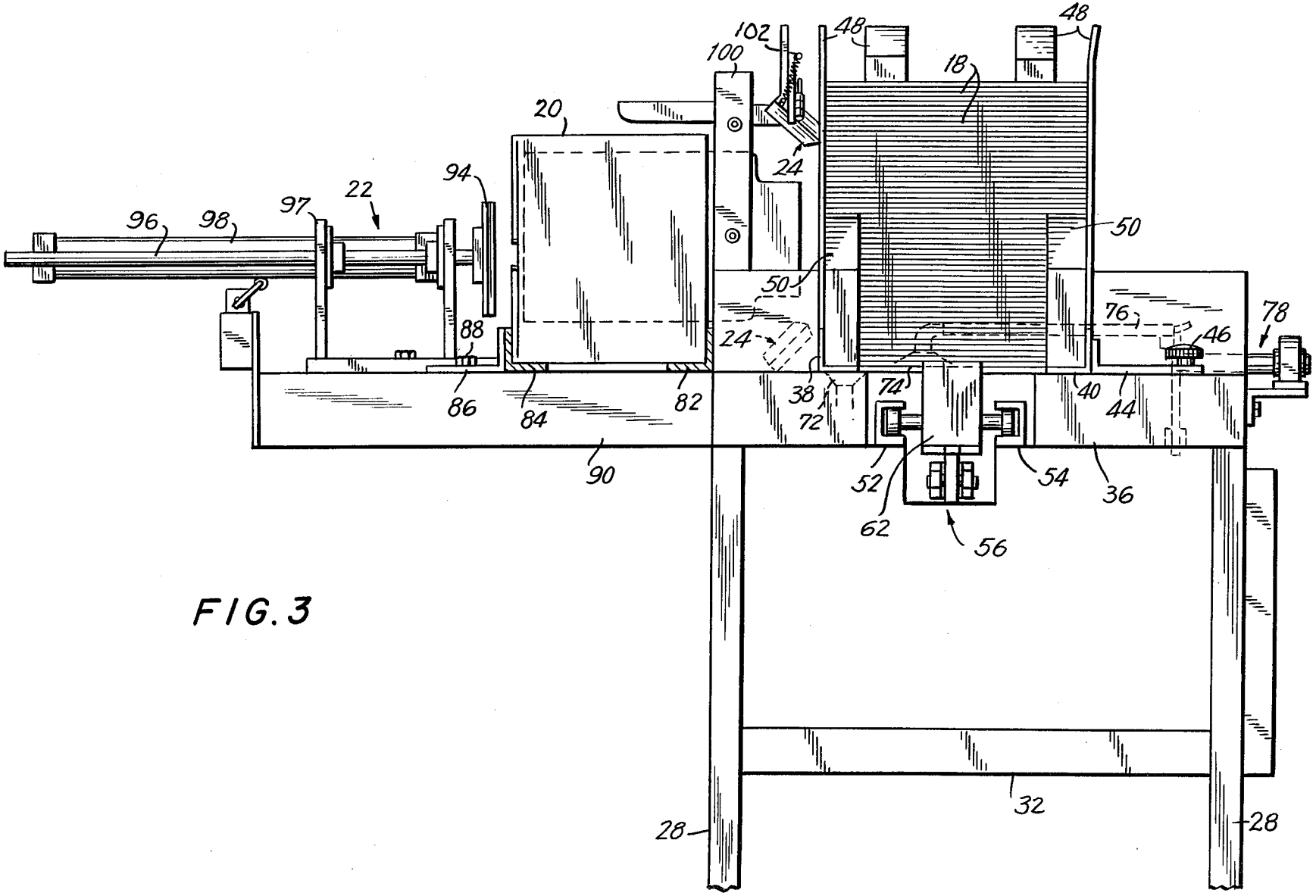
FIG. 3 is an end elevational view of the machine taken along lines 3—3 of FIG. 1.

The erecting and stuffing machine according to the present invention is designated by the numeral 10 in FIGS. 1-3 which illustrate a preferred embodiment of the invention. Broadly, the machine 10 comprises a single wall container feeding station 12, a container blank feeding station 14 and an erecting and telescoping station 16.

A horizontally disposed stack of flat container blanks 18 may be loaded into the container blank feeding station 14 from which single blanks 18 may be delivered to the erecting and telescoping station 16. Within the erecting and telescoping station 16, the flat blank 18 is erected to form a rectangular tube. Preferably, the container blanks 18 comprise four rectangular side panels joined at their lateral edges and four top panels joined respectively to each of the four side panels. When the container blank 18 has been erected, each of the top panels or flaps will be substantially coplanar with the side panel to which it is joined.

Erected and sealed single wall containers 20 are delivered to a container feeding station 12 from a source of supply of such containers, for example, an erecting and sealing machine of the type described in U.S. application Ser. No. 917,483 assigned to the assignee of the present invention. The single wall container 20 preferably comprises four side panels joined at their lateral edges and four bottom panels respectively joined to each of the side panels and sealed to form an open top container or tray.

In accordance with the present invention, a container 20 is brought into register with an erected blank 18 and then the container 20 is telescoped into the erected blank 18 by means of a ram mechanism 22 which cooperates with four oscillatable guide arms 24 to maintain the container and blank in register and to facilitate the telescoping operation.

After the container 20 and erected blank 18 have been assembled to form a completed double wall container, the ram mechanism 22 is withdrawn, the oscillatable guide arms 24 are returned to a disengaged position, and the completed container is ejected from the erecting and telescoping section 16. Simultaneously, a flat blank 18 is delivered to the erecting and telescoping station 16 to commence a new cyle of operation.

The apparatus to be described hereafter is capable, in accordance with the present process, of producing double wall containers at the rate of about 20 to 30 containers per minute depending upon the size of the containers. It will be appreciated that upon ejection of the double wall containers from the machine of the present invention, the containers may be filled with an appropriate product and the top flaps or panels sealed. In its preferred form, the double wall container formed according to the present invention is particularly well suited for food products which may be stacked several cartons high in storage warehouses but which may be opened merely by disengaging the telescoped parts of the container, thereby obviating damage to the contents occasioned by opening the carton with a knife or other sharp instrument.

Referring now to FIGS. 1–3, the erecting and stuffing machine 10 comprises a main frame 26 having four legs 28 located by longitudinal braces 30 and lateral braces 32. The tops of the legs 28 are interconnected by longitudinal frame members 34 and lateral frame members 36. Casters 37 may be fitted on the legs 28 if desired.

A pair of angle members 38, 40 is positioned longitudinally along the machine 10 on the frame members 36 with the horizontal flanges in facing relationship to define a carton blank guideway. The angle member 38 is affixed to the several lateral frame members 36 by a plurality of bolts 42 while the angle member 40 is adapted for transverse adjustment by means of the slotted angles 44 welded to the angle member 40 which may be adjustably locked to the lateral frame members 36 by lockbolts 46. It will be understood that various sizes of carton blanks 18 may be accommodated by the adjustment of the angle member 40.

In the container blank feeding station 14, vertically disposed guide arms 48, 50 are fastened to the track members 38, 40 to properly position the flat carton blanks 18 in the container blank feeding station 14. As best shown in FIGS. 2 and 3, the arms 50 are shorter than the arms 48 so as to facilitate the loading of carton blanks 18 into the blank feeding station.

A pair of channel members 52, 54 is disposed longitudinally of the machine 10 below but parallel to the angle members 38, 40 to define a guideway for the carton blank feeding mechanism 56. The carton blank feeding mechanism 56 comprises a double acting pneumatic cylinder 58 pivotally connected at one end to a support bracket 60 fastened to the main frame 26. The opposite end of the pneumatic cylinder 56 is pivotally connected to a carriage 62 constrained by rollers 64 to move longitudinally along the channel members 52, 54. Spring biased pawls 66, 68 are disposed adjacent each end of the carriage 62 and extend above the upper surface of the horizontal flanges of the angle members 38, 40. Pawl 66 is positioned to engage the bottom blank 18 in the container blank feeding station 14 and deliver the blank to the erecting and telescoping section 16 as the carriage 62 is driven from left to right (as shown in FIGS. 1 and 2) by the double acting pneumatic cylinder 58. Simultaneously, the pawl 68 drives the completed double wall carton out of the erecting and telescoping station 16. As the carriage 62 is returned to its initial position by the double acting pneumatic cylinder 58, the pawls 66, 68 are depressed against spring tension so as to clear the blanks 18 located in the erecting and telescoping section 16 and in the container blank feeding station 14. A stop 70 pivotally mounted on the angle member 38 is controlled by a pneumatic cylinder (not shown). Stop 70 locates the forward end of the carton blank 18 in the erecting station and then is moved out of the path of travel of the completed double wall carton.

After the carton blank 18 has been positioned properly in the erecting station 16 by means of the pawl 66 and the pivoted stop 70, it is held in position by a vacuum cup 72 aligned with the lower side panel of the carton blank 18. A second vacuum cup 74 is mounted on an arm 76 for oscillatory motion in the pillow block assembly 78. An extension of the arm 76 is pivotally connected to one end of a double acting pneumatic cylinder 80, the opposite end of which is pivotally mounted on the main frame 26. The vacuum cup 74 and arm 76 are located to engage the trailing side panel of the blank 18 and rotate the panel about its edge so as to erect the carton blank 18.

Turning now to the single wall container feeding station 12, a pair of angle members 82, 84 are positioned on the main frame 26 so that the horizontal flanges are coplanar with the horizontal flanges of the angle members 38, 40. Angle member 82 may be affixed to the main frame 26 while angle member 84 is adjustable laterally by means of the slotted angles 86 and the lock bolts 88 which engage with lateral support members 90. The angle members 82, 84 define a guideway for erected and sealed single wall containers 20 and may communicate directly with an erecting and sealing machine or with some other appropriate source of supply for such containers 20. As shown in FIGS. 1–3, the container 20 is delivered to the feeding station 12 with its open top facing the erecting station 16 and the sealed bottom adjacent the ram mechanism 22. The lateral position of the container 20 is determined by an adjustable platen 92.

The ram mechanism 22 comprises a ram platen 94 mounted on slide bars 96 for transverse reciprocating motion within journals 97 affixed to the main frame 26 and driven by a double acting pneumatic cylinder 98. Actuation of the ram mechanism 22 causes the container 20 to be driven transversely of the machine 10 from the feeding station 12 into the erecting and telescoping station 16. A U-shaped support structure 100 is mounted on the main frame 26 between the feeding station 12 and the erecting and telescoping station 16. Mounting brackets 102 affixed to the top of the support structure 100 carry the upper oscillatable guide arms 24. The lower oscillatable guide arms 24 may be mounted directly on the main frame 26.

An upper guide platen 104 may be adjustably mounted on the U-shaped support 100 to guide the upper side of the container 20 during its passage from the feeding station 12 to the erecting station 16. A second guide platen 106 adjustably mounted in the support 100 may be aligned with the trailing side of the container 20.

It will be understood that the machine 10 is provided with a vacuum pump (not shown) or source of vacuum to operate the vacuum cups 72, 74; a source of air under pressure (not shown) to operate the pneumatic cylinders 58, 80 and 98 and appropriate valves, switches and timing devices to actuate the pneumatic cylinders in the proper sequence. As the pneumatic system and its controls are well known, it is deemed to be unnecessary to describe them in detail.

Referring now to FIGS. 4–8, the operation of the erecting and stuffing machine 10 and the construction and operation of the oscillatable guide arms 24 will be described in greater detail. FIG. 4 is a fragmentary prespective showing one of the flat carton blanks 18 driven along the guideway formed by the angle members 38 and 40 by the pawl 66 against the pivoted stop 70. FIG. 4 also shows an erected and sealed single wall container 20 positioned on the angle members 82, 84 and against the adjustable platen 92 and ram platen 94. The carton blank erecting arm 76 and pneumatic cylinder 80 are shown in solid lines in the initial contacting position with the carton blank 18. Swinging of the erecting arm 76 in a counterclockwise direction (as viewed in FIG. 4) will cause the blank 18 to be erected and assume the position shown by the phantom lines in FIG. 4. During erection of the blank 18, the lower side panel is held in its original position by the vacuum cup 72. It will be observed that, at this point, neither the container 20 nor the erected blank 18 is in contact with the guide arms 24 which are disposed between the container 20 and the erected blank 18. This relationship is shown in more detail in FIG. 5.

Figure 6:
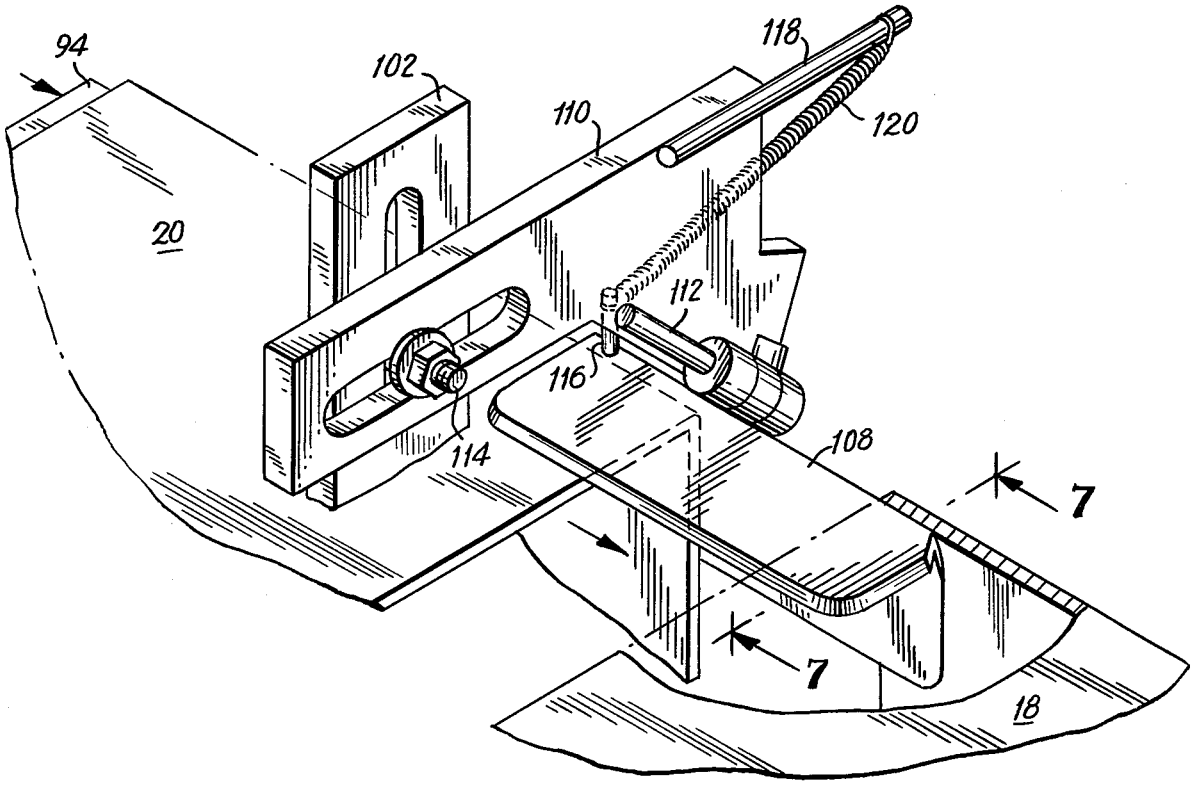
FIG. 6 is a fragmentary perspective view of one of the spring biased oscillating guide arms aligning the corner of the container and erected blank.
Figure 7:
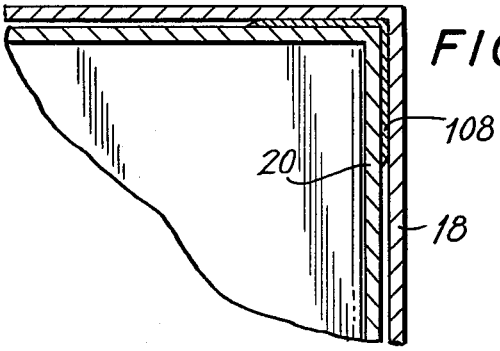
FIG. 7 is a fragmentary view of the container guide arm and erected blank taken along line 7—7 of FIG. 6.
Figure 8:
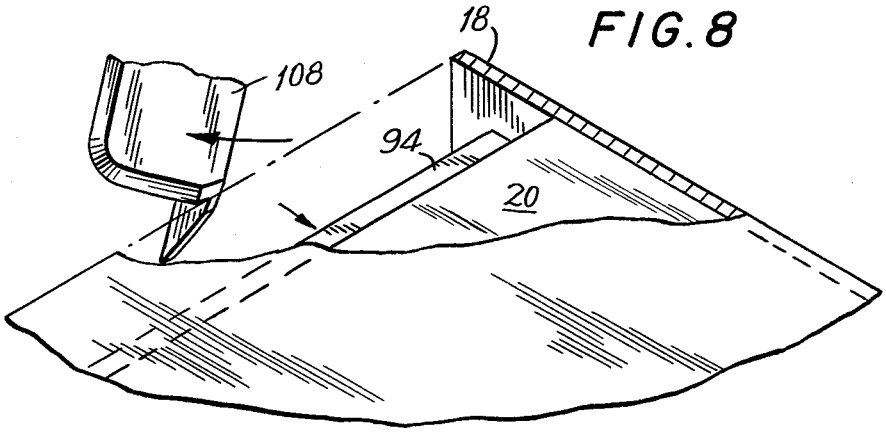
FIG. 8 is a fragmentary perspective view of one of the spring biased oscillating guide arms releasing from engagement with the corners of the telescoped container and erected blank.

Referring now to FIGS. 5 and 6, the oscillatable guide arms 24 comprise an angle guide 108 formed from relatively thin but rigid sheet material, such as stainless steel, which is mounted for oscillatory motion with respect to an adjustable support 110 about a pivot pin 112. The support bar 110 is adjustably fastened to the mounting bracket 102 by a bolt fastener 114. A pin 116 is welded to the outer end of the angle guide 108 and a rod 118 is fastened to the outer end of the support bar 110. A tension spring 120 is connected between the free ends of the pin 116 and rod 118 to bias the angle guide 108 to the disengaged position illustrated in FIG. 5.

As the ram platen 94 urges the container 20 in a transverse direction toward the erected carton blank 18, the forward corners of the container 20 contact the inner surface of each of the angle guides 108 and align the guides 108 with the corners of the erected blank 18 (See FIG. 6). It will be appreciated that further movement of the ram platen 94 will cause the container 20 to telescope with the erected blank 18 and "sandwich" the angle guides 108 therebetween (See FIG. 7). The angle guides 108 facilitate the "telescoping" process and insure that the container 20 and erected blank 18 are precisely in register during the process. Continued transverse movement of the ram platen 94 ultimately drives the container 20 past the outer end of the angle guide 108 (See FIG. 8) whereby the tension spring 120 biases the angle guide 108 back to the disengaged position shown in FIG. 5.

After the angle guides 108 have disengaged from the completed double wall container, the completed container may be ejected from the machine 10 by the pawl 68 (FIG. 1) while a new blank 18 is delivered to the erecting station 16 to begin another cycle of the machine.

Erecting and stuffing or telescoping machines according to the present invention can be built to accommodate a variety of carton sizes. For example, a machine handling cartons having a range of lengths between 15½ and 18", widths from 6 to 11¼" and depths from 10½ to 12¼" is capable of erecting and stuffing up to 30 cartons per minute. A somewhat larger machine handling cartons having a range of lengths between 15¼" and 21½", widths from 6 to 13½" and depths from 10½ to 12½" is capable of erecting and stuffing up to 20 cartons per minute. In these examples, the "length" and "width" measurements are taken along the length and width of the machine while the "depth" measurement is measured vertically from the angle members forming the guideway for the cartons through the machine.

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. In a process for forming a double wall container from a container blank comprising four side panels pivotally joined at opposite edges and having two top side flaps and two top end flaps, each of which is joined respectively to one of said side panels, and an erected and sealed container comprising four side panels joined at opposite sides and having two bottom side flaps and two bottom end flaps said end flaps being sealed to said side flaps, the steps comprising: positioning a plurality of said container blanks in a blank feeding station of a container erecting and telescoping machine to form a vertical column with each of said container blanks lying in a horizontal plane; driving the lowermost container blank from said vertical column of container blanks into an erecting and telescoping station; erecting said container blank by applying a turning moment to the trailing side panel of said container blank while maintaining the lower side panel of said container blank stationary in a horizontal plane; positioning an erected and sealed container in a container feeding station with its open top facing said erecting and telescoping station and in alignment with said erected container blank; driving said erected and sealed container into engagement with a plurality of guide arms, each of said guide arms engaging an outer surface of said erected and sealed container at an outside corner thereof; further driving said erected and sealed container and each of said guide arms into engagement with an inside corner of said erected container blank; further driving said erected and sealed container into telescoping relation with said erected container blank until said guide arms are released from engagement with the outer corners of said erected container blank to form a double wall container; and simultaneously ejecting said double wall container from said erecting and telescoping machine while driving a subsequent container blank into said erecting and telescoping station.

2. Apparatus for erecting a container blank and telescoping said erected blank with an erected and sealed container including a blank feeding station, a blank erecting and telescoping station and an erected and sealed container feeding station comprising a longitudinal guideway arranged to guide a container blank in a horizontal direction, vertical guide means defining said container blank feeding station adjacent one end of said longitudinal guideway to accommodate a stack of horizontally disposed container blanks, reciprocating container blank feeding means communicating with the lowermost container blank in the stack of container blanks to feed said container blank into said erecting and telescoping station against a movable stop, vacuum restraining means located below said longitudinal guideway to engage a lower side panel of said container blank, vacuum erecting means swingably mounted to engage with an upper trailing side panel of said container blank to erect said container blank, adjustable platen means to align an erected and sealed container in said erected and sealed container feeding station with said erected container blank, ram means arranged to move transversely to said longitudinally guideway, four oscillatable guide arms located intermediate said container feed station and said erecting and telescoping station and engageable respectively with the four outer corner surfaces of said erected and sealed container and with the four inner corner surfaces of said erected container blank, and driving means movable within said erecting and telescoping station to eject said erected and sealed container from said erecting and telescoping station.

3. Apparatus as described in claim 2 wherein the driving means for ejecting a container from the erecting and telescoping station are integral with said reciprocating container blank feeding means.

* * * * *